US009068797B2

(12) United States Patent
Hale

(10) Patent No.: US 9,068,797 B2
(45) Date of Patent: Jun. 30, 2015

(54) DYNAMIC REAL-TIME BORESIGHTING SYSTEM AND METHOD

(75) Inventor: Michael Wayne Hale, Fort Worth, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 534 days.

(21) Appl. No.: 13/527,636

(22) Filed: Jun. 20, 2012

(65) Prior Publication Data

US 2012/0317773 A1 Dec. 20, 2012

Related U.S. Application Data

(60) Provisional application No. 61/498,710, filed on Jun. 20, 2011.

(51) Int. Cl.
*F41G 3/32* (2006.01)

(52) U.S. Cl.
CPC ..... *F41G 3/323* (2013.01); *Y10T 29/53022* (2015.01); *Y10T 29/49778* (2015.01)

(58) Field of Classification Search
CPC ..... F41G 3/323
USPC ..... 702/152
See application file for complete search history.

(56) References Cited

U.S. PATENT DOCUMENTS

| | | | | |
|---|---|---|---|---|
| 5,502,650 | A * | 3/1996 | Naruse et al. | 700/279 |
| 2007/0011683 | A1 * | 1/2007 | Helander | 718/104 |
| 2009/0082918 | A1 * | 3/2009 | Hendrix, Jr. | 701/33 |

* cited by examiner

*Primary Examiner* — Bryan Bui
(74) *Attorney, Agent, or Firm* — Prakash Nama; Daniel J. Long

(57) ABSTRACT

Disclosed is a dynamic real-time boresighting system and method. In one embodiment, the method includes obtaining a mapping function by associating deflection and rotation data of strategically located at least two sensors with sensor deflection data, real-time or static sensor readings from at least two sensors which are strategically located on the component in the aircraft or the land vehicle, while the aircraft or the land vehicle is moving or static respectively and determining an alignment of the component by comparing the real-time or static sensor readings obtained from the strategically located at least two sensors with the obtained mapping function.

13 Claims, 4 Drawing Sheets

DYNAMIC REAL-TIME BORESIGHTING SYSTEM AND METHOD

CROSS-REFERENCE TO RELATED APPLICATIONS

This Application claims rights under 35 USC §119(e) from U.S. Application Ser. No. 61/498,710 filed Jun. 20, 2011, and under 35 U.S.C. 119(a)-(d) to Foreign application Serial No 2435/CHE/2012 filed in INDIA entitled "DYNAMIC REAL-TIME BORESIGHTING SYSTEM AND METHOD" filed on Jun. 19, 2012, and the contents of which are incorporated herein by reference.

BACKGROUND OF THE INVENTION

1. Field of the Invention

The present invention relates to sighting systems, and more particularly, to boresight harmonization and alignment systems.

2. Brief Description of Related Art

Typically, boresight alignment or harmonization of mounting provisions of a system or component in an aircraft or a land vehicle requires removing the equipment from the aircraft or the land vehicle. Upon completing the harmonization, the harmonized equipment is re-installed and the system undergoes a functional check. The harmonization may be done with multiple adapters with varying degrees of complexity and expends valuable time and resources. The boresight adapters themselves require alignment and calibration, typically involving rigs and elaborate calibration setups.

Further, there may be some additional disadvantages to the traditional boresight alignment systems. These possible disadvantages may include unstable weapon system targeting accuracy, high acquisition and life cycle costs, high failure rate, regular maintenance or calibration checks, lack of built-in-test (hard to determine cause of failure and corrective action), and a large logistic footprint. Current systems may also require a high level of skill and constant training to use. A minimum of two and normally three to five operators are needed and platform systems must often be removed prior to any checks. In addition to the requirement of significant resources and time, the current boresight alignment systems are static and generally do not take airborne structure flexures into account.

SUMMARY OF THE INVENTION

Disclosed is a dynamic real-time boresighting system and method. In one embodiment, the method includes obtaining a mapping function by associating deflection and rotation data of strategically located at least two sensors with sensor deflection data, wherein the deflection and rotation data are obtained from the at least two sensors strategically located on a three dimensional (3D) surface model, receiving real-time or static sensor readings from at least two sensors strategically located on a component in an aircraft or a land vehicle, while the aircraft or the land vehicle is moving or static, respectively and determining an alignment of the component by comparing the real-time or static sensor readings obtained from the strategically located at least two sensors with the obtained mapping function.

Further, associating the deflection and rotation data of the strategically located at least two sensors with sensor deflection data includes associating the deflection and rotation data obtained from the at least two sensors which are strategically located on the 3D surface model. The deflection and rotation data of the 3D surface model includes the deflection and rotation data with respect to roll, pitch and yaw of the aircraft or the land vehicle. Furthermore, the 3D surface model is derived using a structural truth model or an existing mathematical model. In addition, the deflection and rotation data of the 3D surface model are determined by applying a predetermined number of known loads on the component. In one embodiment, the 3D surface model is a computer generated model of the aircraft or the land vehicle.

Furthermore, the method includes dynamic real-time or static harmonizing of the component of the aircraft or the land vehicle based on the determined alignment of the component.

In another embodiment, the system includes a dynamic real-time computing system to store a mapping function. Further, the dynamic real-time computing system obtains real-time or static sensor readings from the strategically located at least two sensors on the component while the aircraft or the land vehicle is moving or static, respectively, and the dynamic real-time computing system determines an alignment of the component by comparing the real-time or static sensor readings obtained from the strategically located at least two sensors with the obtained mapping function.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

DETAILED DESCRIPTION OF THE INVENTION

The exemplary embodiments described herein in detail for illustrative purposes are subject to many variations in structure and design.

The terms, "boresight alignment" and "boresight harmonization" and "harmonization" are used interchangeably throughout the document.

Disclosed is a dynamic real-time boresighting system and method. Dynamic real-time boresighting is required for harmonizing one or more components in an aircraft or land vehicle. In a preferred embodiment, a mathematical surface approximation is used. The mathematical surface approximation includes deriving a 3D surface model of a platform from an existing mathematical model or a structural truth model, acquiring sensor readings from at least two sensors which are strategically located on the 3D surface model of the platform and determining a mapping function that converts real-time or static sensor readings to correspond to deflection and rotation data. Further, real-time or static sensor readings are received from at least two sensors which are strategically located on the component of the aircraft or the land vehicle and an alignment of the component is determined by comparing the real-time or static sensor readings obtained from the strategically located at least two sensors with the obtained mapping function.

In another preferred embodiment, the derived 3D surface model is given predetermined number of loads to determine bending and flexing data. The bending and flexing data obtained upon applying the predetermined number of loads are converted to deflection and rotation data. Further, the mapping function is obtained by associating the converted deflection and deflection data to sensor deflection data obtained from the at least two sensors strategically located on the 3D surface model.

Figure 1:
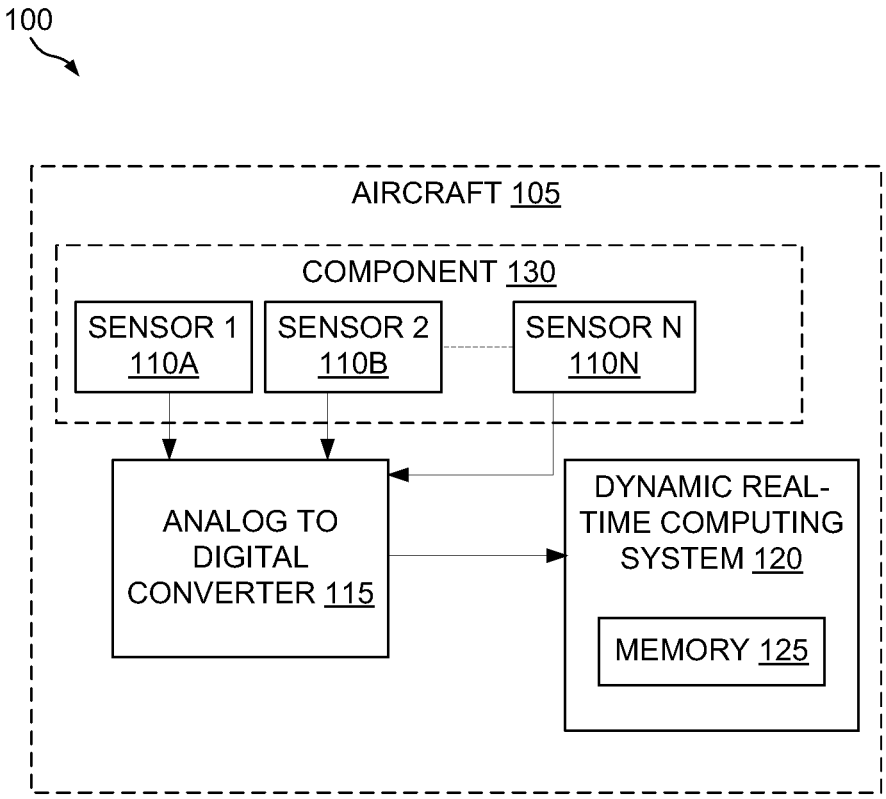
FIG. 1 is a schematic of a dynamic real-time boresight alignment system, according to an embodiment of the present subject matter.

FIG. 1 is a schematic of a dynamic real-time boresight alignment system 100, according to an embodiment of the present subject matter. As shown in FIG. 1, the dynamic real-time boresight alignment system 100 includes an aircraft 105. Further, the aircraft 105 includes a plurality of sensors such as sensor 1 110A, sensor 2 110B to sensor N 110N, an analog to digital (A/D) converter 115, a dynamic real-time computing system 120 and a component 130. Furthermore, the dynamic real-time computing system 120 includes memory 125. In one embodiment, the memory 125 stores a mapping function.

In this embodiment, the at least two sensors are sensor 1 110A and sensor 2 110B. The at least two sensors sensor 1 110A, sensor 2 110B are strategically located in/on the component 130 of the aircraft 105. The component 130 in the aircraft 105 includes but not limited to a wing, weapons, an engine, an inertial navigation unit (INU), a gun pod and a radio detection and ranging unit (RADAR).

Moreover, The A/D converter 115 is operatively coupled between the dynamic real-time computing system 120 and the at least two sensors sensor 1 110A and sensor 2 110B. In one embodiment, the A/D converter 115 converts analog data obtained from the strategically located at least two sensors sensor 1 110A and sensor 2 110B to digital data and sends the digital data to the dynamic real-time computing system 120.

In one embodiment, the mapping function is obtained by the dynamic real-time computing system 120. The dynamic real-time computing system 120 derives a 3D surface model of the component 130 in the aircraft or the land vehicle using a structural truth model or an existing mathematical model, determines the deflection and rotational data at the strategically located at least two sensors on the 3D surface model by applying a predetermined number of known loads on the component 130 and obtains the mapping function based on the determined deflection and rotation data associated with the strategically located at least two sensors with the sensor deflection data.

In another embodiment, the dynamic real-time computing system 120 determines bending and flexing data associated with the 3D surface model upon applying the predetermined number of loads. The bending and flexing data are then converted to the deflection and rotation data. In addition, the mapping function is used to associate the converted deflection and rotation data to the sensor deflection data obtained from the at least two sensors located on the 3D surface model.

In operation, the dynamic real-time computing system 120 obtains real-time or static sensor readings from the strategically located at least two sensors sensor 1 110A and sensor 2 110B in/on the component 130 while the aircraft 105 is moving or static, respectively. In one embodiment, the dynamic real-time computing system 120 obtains the real-time sensor readings when the aircraft 105 is moving. In another embodiment, the dynamic real-time computing system 120 obtains the static sensor readings when the aircraft 105 is static. The at least two sensors sensor 1 110A and sensor 2 110B provide roll, pitch and yaw measurements at the strategically located positions in/on the component 130 of the aircraft 105. The dynamic real-time computing system 120 determines an alignment of the component 130 by comparing the real-time or static sensor readings obtained from the strategically located at least two sensors sensor 1 110A and sensor 2 110B with the mapping function. Further, the dynamic real-time computing system 120 harmonizes the component 130 of the aircraft 105 based on the determined alignment of the component 130.

In yet another embodiment, the dynamic real-time computing system 120 determines the alignment by calculating an angular deviation by comparing the real-time or static sensor readings obtained from the at least two sensors sensor 1 110A, and sensor 2 110B with the mapping function.

In yet another embodiment, the strategically located at least two sensors are solid-state "gyro-on-a chip" type of sensors including one micro machined piece of vibrating crystalline quartz tuning fork sensing element that is capable of outputting voltage when rotated about the sensor's input axis. Further, the strategically located at least two sensors are sensor 1 110A and sensor 2 110B. Alternatively, the strategically located at least two sensors are the sensors on the 3D surface model.

In addition, the voltage outputted from the at least two sensors strategically located on the 3D surface model are converted to the deflection and rotation data and used in the mapping function. For example, the mapping function is stored in form of a lookup table. Moreover, the lookup includes the outputted voltage and corresponding deflection and rotation data.

Figure 2:
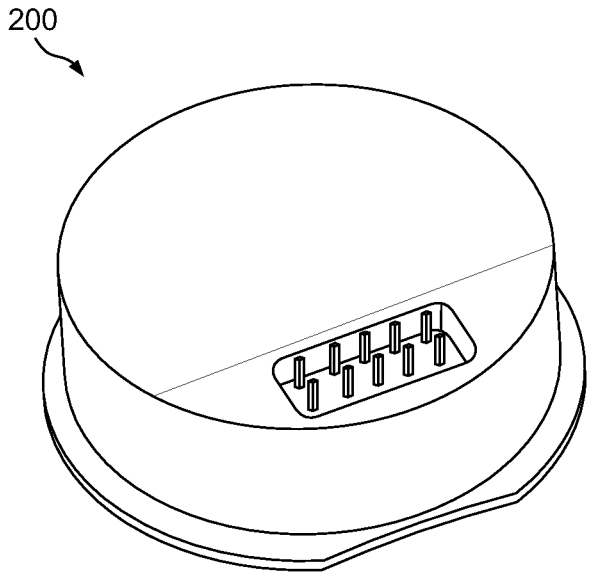
FIG. 2 is a schematic of a sensor shown in FIG. 1, according to an embodiment of the present subject matter.

FIG. 2 is a schematic of a sensor 200, according to an embodiment of the present subject matter. For example, the sensor 200 is the sensor 1 110A, the sensor 2 110B to the sensor N 110N of FIG. 1. The sensor 200 is strategically located on a component of an aircraft or a land vehicle. Alternatively, the sensor 200 is strategically located on a 3D surface model. Further, the sensor 200 is strategically located on the component of the aircraft for which the boresight alignment has to be determined. Furthermore, the boresight alignment is determined when the aircraft is moving or static. In one embodiment, the sensor 200 is strategically located on the component of the aircraft. Further, the sensor 200 provides pitch, roll and yaw measurements at the strategically located positions on the component of the aircraft. In another embodiment, the sensor 200 is strategically located on the 3D surface model. Further, the sensor 200 provides pitch, roll and yaw measurements at the strategically located positions on the 3D surface model.

In yet another embodiment, the sensor 200 is a solid-state "gyro on a chip" (such as 3-axis accelerometers) including one micro machined piece of vibrating crystalline quartz tuning fork sensing element that is capable of outputting voltage when rotated about the sensor's input axis. Further, the sensor 200 has an accuracy that exceeds a required aircraft boresight tolerance of about 2-3 arc minutes.

In yet another embodiment, the sensor 200 is a motion type sensor and the output of the motion type sensor is consistently fed to a dynamic real-time computing system. The sensor 200 is active during the dynamic real-time computing system operation. Therefore, real-time sensor readings are sent to the dynamic real-time computing system, thus reducing dynamic errors that occur during flight.

For instance, the sensor 200 is a direct current (DC) input/high-level DC output device that is fully self-contained, extremely small, and lightweight. Since an inertial sensing element includes just one micro machined piece of crystalline quartz (no moving parts), it can have a virtually unlimited life. The sensor 200 is a mature product that is produced in high volume. The sensor 200 is used on numerous advanced aircrafts, missiles, and space systems. For example, on applying Coriolis Effect, a rotational motion about the sensor's input axis produces a DC voltage output proportional to the rate of rotation. The sensor 200 uses a piezoelectric quartz material that simplifies the active element resulting in stability over temperature and product life. The accuracy of these sensors are typically in the range of about 1.7 to 5 arc seconds and they far exceed the required aircraft boresight tolerance of about 2 to 3 arc minutes.

Figure 3:
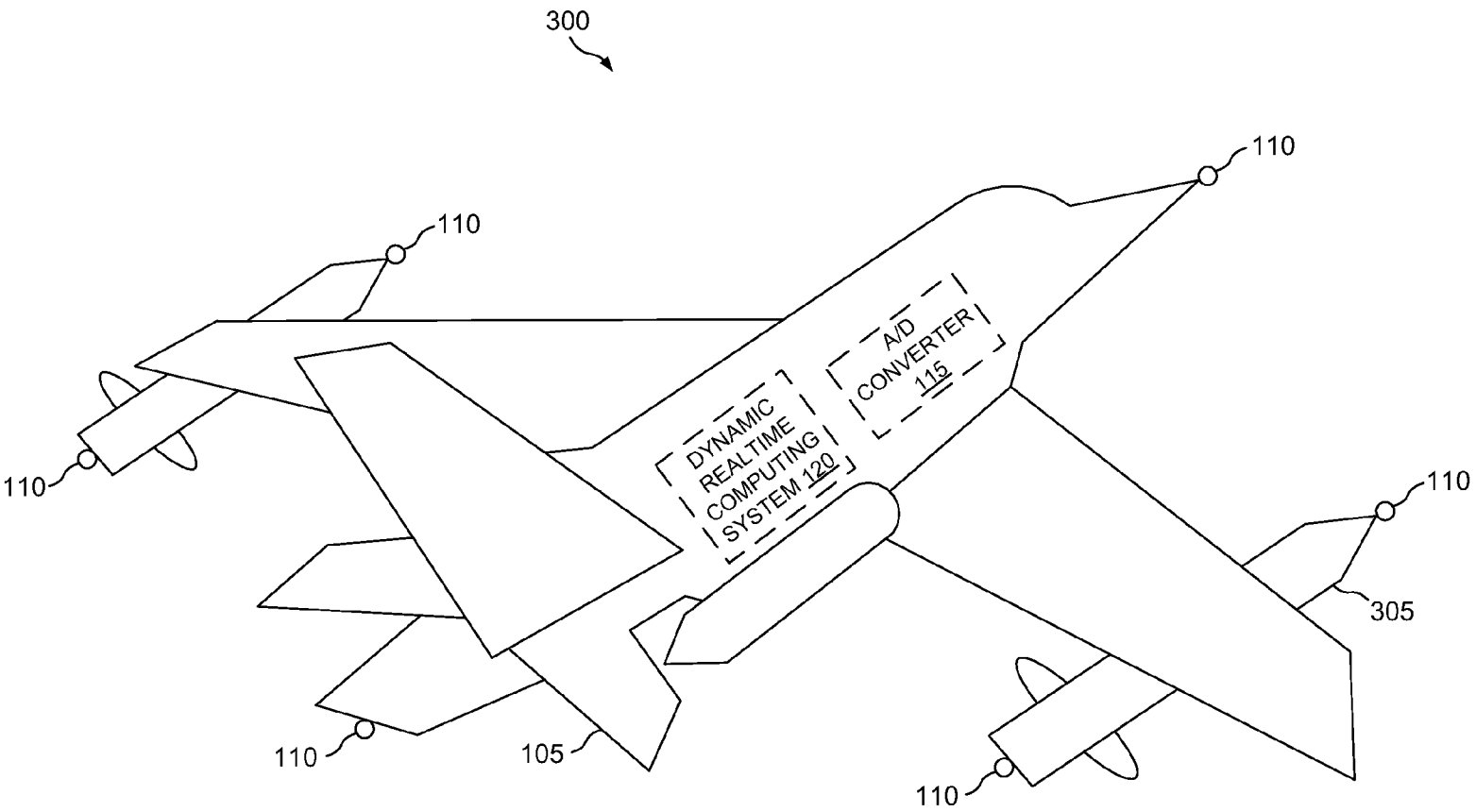
FIG. 3 is a schematic of an aircraft having strategically located at least sensors on a component of the aircraft, according to an embodiment of the present subject matter.

FIG. 3 is a schematic of the aircraft 105 having strategically located at least two sensors 110 on a component of the aircraft 105, according to an embodiment of the present subject matter. 300 of FIG. 3, includes the aircraft 105, the strategically located at least two sensors 110 (such as sensor 1 110A, sensor 2 110B to sensor N 110N of FIG. 1) and the component such as a missile 305. Further, the aircraft 105 includes the A/D converter 115 and the dynamic real-time computing system 120. The at least two sensors 110 are strategically located on the component such as the missile 305 of the aircraft 105 for which boresight alignment has to be dynamically and/or statically determined. In another embodiment, the at least two sensors 110 are strategically located on a nose and a wing of the aircraft 105. In yet another embodiment, real-time sensor readings are obtained from the strategically located at least two sensors 110, when the aircraft 105 is moving. In another embodiment, static sensor readings are obtained from strategically located at least two sensors 110, when the aircraft 105 is static. The boresight alignment is performed dynamically and/or statically by using the at least two sensors 110, the A/D converter 115 and the dynamic real-time computing system 120 as described in FIG. 1.

Figure 4:
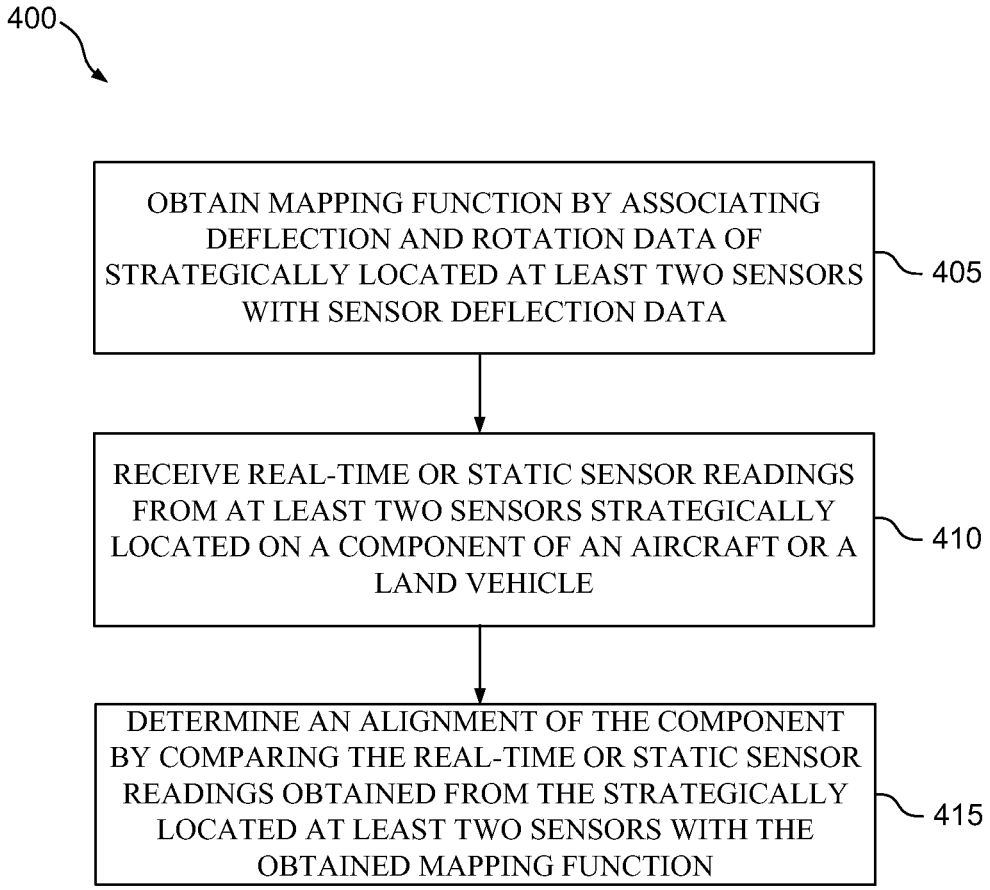
FIG. 4 illustrates a flowchart for dynamic real-time harmonizing of a component in an aircraft or a land vehicle, according to an embodiment of the present subject matter.

FIG. 4 illustrates a flowchart 400 for dynamic real-time boresighting of a component in an aircraft or a land vehicle, according to an embodiment of the present subject matter. At block 405, a mapping function is obtained by associating deflection and rotation data of strategically located at least two sensors with sensor deflection data. In one embodiment, obtaining the mapping function includes deriving a 3D surface model of the component in the aircraft or the land vehicle using a structural truth model or an existing mathematical model, determining the deflection and rotational data at the strategically located at least two sensors on the 3D surface model by applying a predetermined number of known loads on the component and obtaining the mapping function based on the determined deflection and rotation data associated with the strategically located at least two sensors with the sensor deflection data.

In another embodiment, determining the deflection and rotational data at the strategically located at least two sensors on the 3D surface model by applying a predetermined number of known loads on the component includes determining bending and flexing data upon applying the predetermined number of known loads on the component. The bending and flexing data are then converted to the deflection and rotation data. The mapping function is used to associate the converted deflection and rotation data to sensor deflection data obtained from the strategically located at least two sensors on the 3D surface model. For example, the mapping function is stored in a lookup table. The lookup table includes the outputted voltage of the at least two sensors and corresponding deflection and rotation data.

At block 410, real-time or static sensor readings are received from at least two sensors strategically located on the component in the aircraft or land vehicle, while the aircraft or the land vehicle is moving or static, respectively. The component of the aircraft includes but not limited to a wing, weapons, an engine, an INU, gun pod, or RADAR unit. In one embodiment, the real-time sensor readings are received when the aircraft is moving. In another embodiment, the static sensor readings are received when the aircraft is static. Further, the at least two sensors provide roll, pitch and yaw measurements at the strategically located positions on the component. For instance, the at least two sensors is placed on the wing of the aircraft for which boresight alignment has to be determined. In such case, the at least two sensors provide roll, pitch and yaw measurements associated to the wing of the aircraft.

At block 415, an alignment of the component is determined by comparing the real-time or static sensor readings obtained from the strategically located at least two sensors with the obtained mapping function. The real-time or static sensor readings are obtained from the at least two sensors that are located on the component of the aircraft. Further, determining the alignment of the component includes calculating an angular deviation by comparing the real-time or static sensor readings obtained from the at least two sensors that are strategically located on the component in the aircraft with the deflection and rotation data in the obtained mapping function.

Furthermore, the method includes dynamic real-time or static harmonizing of the component located in the aircraft or the land vehicle based on the determined alignment of the component.

In a preferred embodiment, the at least two sensors are solid-state "gyro-on-a chip" type of sensors (such as 3-axis accelerometers) including one micro machined piece of vibrating crystalline quartz tuning fork sensing element that is capable of outputting voltage when rotated about the sensor's input axis. Further, the sensor has an accuracy that exceeds a required aircraft boresight tolerance of about 2-3 arc minutes.

Even though the above method and system are described with reference to an aircraft, one can envision using this idea for land vehicles.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A method for dynamic real-time boresighting of a component in an aircraft or a land vehicle comprises:

obtaining, by a dynamic real-time computing system, deflection and rotation data of the component;

receiving, by the dynamic real-time computing system, real-time or static sensor readings from at least two sensors strategically located on the component in the aircraft or the land vehicle, while the aircraft or the land vehicle is moving or static, respectively; and determining an alignment of the component by comparing the real-time or static sensor readings obtained from the strategically located at least two sensors with the obtained deflection and rotation data by the dynamic real-time computing system.

2. The method of claim 1, further comprising:

dynamic real-time or static harmonizing of the component located in the aircraft or the land vehicle based on the determined alignment of the component.

3. The method of claim 1, wherein obtaining the deflection and rotation data of the component comprises:

deriving a three dimensional (3D) surface model of the component in the aircraft or the land vehicle using a structural truth model; and determining the deflection and rotational data associated with the 3D surface model of the component by applying a predetermined number of known loads on the component.

4. The method of claim 1, wherein the at least two sensors provide pitch, roll and yaw measurements at the strategically located positions on the component.

5. The method of claim 1, wherein the at least two sensors are solid-state "gyro-on-a chip" type of sensors including one micro machined piece of vibrating crystalline quartz tuning fork sensing element that is capable of outputting voltage when rotated about a sensor's input axis.

6. The method of claim 1, wherein the at least two sensors having an accuracy that exceeds a required aircraft boresight tolerance requirements of about 2-3 arc minutes.

7. The method of claim 1, wherein the component of the aircraft is a wing, weapons, an engine, a inertial navigation unit (INU), a gun pod, or an radio detection and ranging unit (RADAR).

8. The method of claim 1, wherein determining the alignment of the component by comparing the real-time or static sensor readings obtained from the strategically located at least two sensors with the obtained deflection and rotation data, comprises:

calculating an angular deviation by comparing the real-time or static sensor readings obtained from the strategically located at least two sensors with the obtained deflection and rotation data; and determining the alignment of the component based on the calculated angular deviation.

9. A system for dynamic real-time boresighting of a component in an aircraft or a land vehicle, comprising:

at least two sensors that are strategically located on the component of the aircraft or the land vehicle;

a dynamic real-time computing system located in the aircraft or the land vehicle, wherein the dynamic real time computing systems includes memory to store deflection and rotation data of the component; and an analog to digital (A/D) converter operatively coupled between the dynamic real time computing system and the at least two sensors, wherein the dynamic real-time computing system obtains real-time or static sensor readings from the strategically located at least two sensors on the component while the aircraft or the and vehicle is moving or static, respectively, and wherein the dynamic real-time computing system determines an alignment of the component by comparing the real-time sensor or static sensor readings obtained from the strategically located at least two sensors with the stored deflection and rotation data.

10. The system of claim 9, wherein the dynamic real-time computing system derives a three-dimensional (3D) surface model of the component in the aircraft or the land vehicle using a structural truth model, and wherein the dynamic real-time computing system determines the deflection and rotational data associated with the 3D surface model of the component by applying a predetermined number of known loads on the component.

11. The system of claim 9, wherein the at least two sensors provide pitch, roll and yaw measurements at the strategically located positions on the component.

12. The system of claim 9, wherein the dynamic real-time computing system harmonizes the component located in the aircraft or the land vehicle based on the determined alignment of the component.

13. The system of claim 9, wherein the dynamic real-time computing system calculates an angular deviation b comparing the real-time or static sensor readings obtained from the strategically located at least two sensors with the obtained deflection and rotation data, and determines the alignment of the component based on the calculated angular deviation.

* * * * *